United States Patent [19]

Klundt

[11] Patent Number: 4,539,922

[45] Date of Patent: Sep. 10, 1985

[54] NEEDLE BAR DRIVE FOR COUNTERBALANCED SEWING MACHINES

[75] Inventor: Kurt Klundt, Hirschhorn, Fed. Rep. of Germany

[73] Assignee: G.M. Pfaff AG, Fed. Rep. of Germany

[21] Appl. No.: 661,405

[22] Filed: Oct. 16, 1984

[30] Foreign Application Priority Data

Nov. 17, 1983 [DE] Fed. Rep. of Germany ..... 3341444

[51] Int. Cl.[3] ..... D05B 55/14

[52] U.S. Cl. ..... 112/221; 74/591; 74/604

[58] Field of Search ..... 112/221; 74/603, 604, 74/591

[56] References Cited

U.S. PATENT DOCUMENTS

| | | | |
|---|---|---|---|
| 2,128,120 | 8/1938 | Christensen et al. | 112/221 |
| 3,040,682 | 6/1962 | Leslie | 112/221 |
| 3,318,274 | 5/1967 | Schoij | 112/221 X |
| 3,797,327 | 3/1974 | Voorhees et al. | 74/604 |
| 4,458,611 | 7/1984 | Arendash | 112/221 |

OTHER PUBLICATIONS

Die Dynamik der Verbrennungsknaftmaschine, H. Schnon, Springer–Verlag, Wien 1942.

*Primary Examiner*—Werner H. Schroeder
*Assistant Examiner*—Andrew M. Falik
*Attorney, Agent, or Firm*—McGlew and Tuttle

[57] ABSTRACT

The needle bar drive of a counterbalanced sewing machine comprises, in addition to a counterbalance weight connected to the driving crank, a second counterbalance weight which is driven in opposition thereto through a drive mechanism. The drive mechanism comprises an intermediate shaft which rotates at a double speed relative to the armshaft and carries and drives a third counterbalance weight.

3 Claims, 3 Drawing Figures

Fig. 1
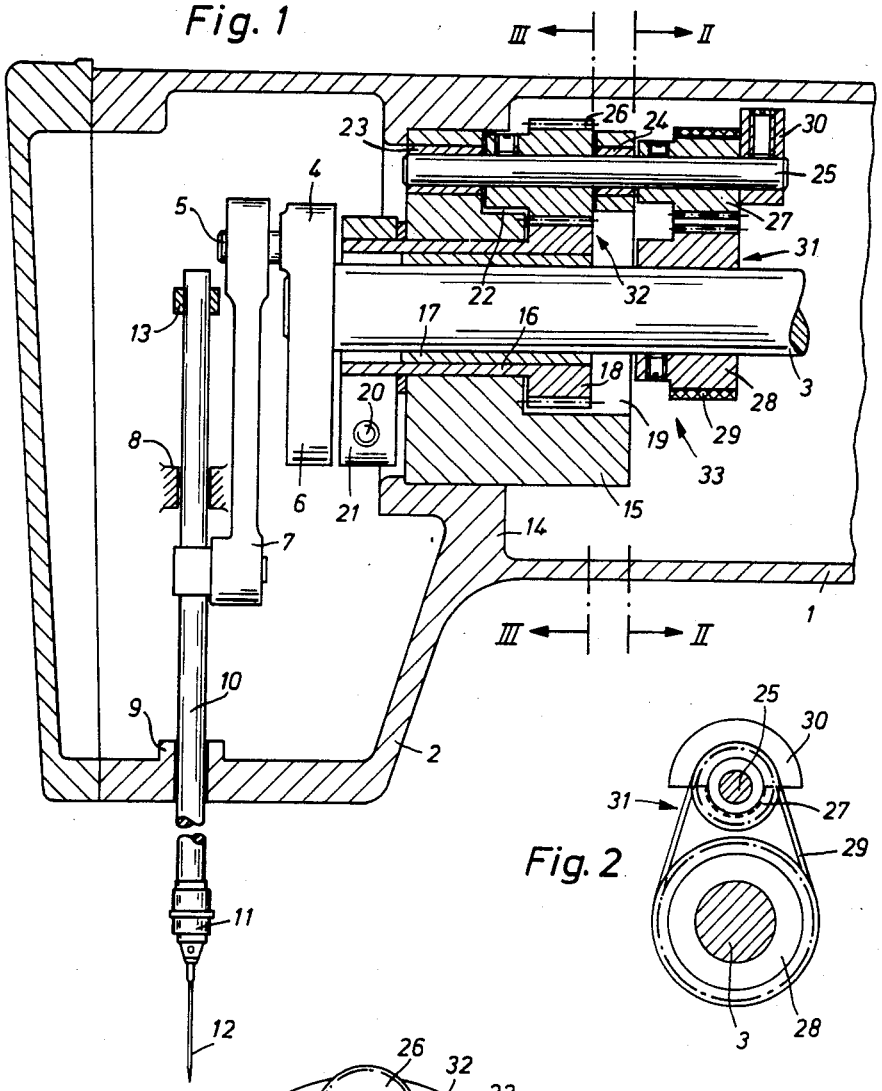
Fig. 2
Fig. 3
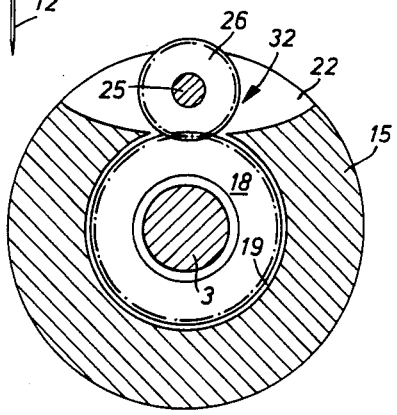

NEEDLE BAR DRIVE FOR COUNTERBALANCED SEWING MACHINES

FIELD AND BACKGROUND OF THE INVENTION

This invention relates in general to sewing machines and in particular to a new and useful sewing machine counterbalanced needle bar drive.

In conventional sewing machines having their needle bar drive designed as a crank drive, a counterbalance weight firmly secured to the armshaft of the machine is provided rotating in opposition to the crankpin (U.S. Pat. No. 2,128,120). The counterweight is selected to equilibrate the rotating masses, namely the crank arm with the crank pin and a portion of the needle bar link, and partly the vertical first order inertia forces which are caused by the needle bar and a portion of the needle bar link. This partial compensation, however, is a compromise justifiable only for low-speed to medium speed sewing machines, since along with a partial compensation for the vertical inertia forces, a horizontal component develops, so that a rotary inertia force vector is produced varying in magnitude. In high speed sewing machines, such non-compensated inertia forces cause strong vibrations of the machine housing adversely affecting the operation.

U.S. Pat. No. 3,318,274 discloses a sewing machine having features which include a counterbalance drive in which the crank pin connected through a link to a needle bar forms a part of a gimbal mounting. As is well known, a gimbal suspension produces a purely sinusoidal motion of the needle bar. In addition to the usual counterbalance weight connected directly to the armshaft, a second counterbalance weight is provided which is connected to the driver of the gimbal mount and rotates in the opposite direction. Due to the two counterbalance weights the inertia forces which are produced by the sinusoidal drive of the needle bar and are of first order only, become completely balanced. Since the two counterweights rotate in opposite directions, their horizontal force components are always mutually opposed and compensate each other.

In contradistinction to sinusoidally moved needle bars, needle bars driven through a crank have a longer period of dwell at the upper point of reversal, so that a longer interval is available for the feed of the work. Along with lower costs of crank drives, this is a reason for designing needle bar drives mostly as crank drives, not as gimbal ring drives.

It is known that in a needle bar drive designed as a crank drive, also second order inertia forces are produced, in addition to the first order ones. The magnitude of these second order inertia forces is proportional, among others, to the square of the angular velocity and to the ratio of crank radius-to-length of the needle bar link. Solutions to the equilibration of inertia forces of first and second order in crank drives are known in the field of internal combustion engines, for example from the book "Die Dynamik der Verbrennungskraftmaschine (Dynamics of Internal Combustion Engines) by H. Schron, Springer Publication, Vienna 1942, page 43. The solution shown there in FIG. 16 however, is very expensive and requires much space and is therefore unsuitable for sewing machines.

SUMMARY OF THE INVENTION

The invention is directed to a needle bar drive designed as a crank drive in which the occurring inertia forces of first and second order are widely counterbalanced in a simple and, primarily, space-saving manner.

By providing an intermediate shaft which is driven by the armshaft at a speed ratio of 1:2 through a transmission gear and connected to the second counterbalance weight through a reduction gearing having a speed ratio of 2:1, with one of the gearings reversing the direction of rotation relative to the armshaft, the second counterbalance weight is driven opposite to the first one in a mechanically simple way, and, at the same time, favorable conditions are created for mounting without additional expenses a counterbalance weight rotating at a double speed and compensating for intertia forces of the second order produced by the needle and a portion of the needle bar link.

Since with the provision of a single counterbalance weight rotating at a double speed, a continually varying horizontal force component is produced, the counterbalance weight is intentionally reduced to a magnitude making sure that the vertical inertia forces of the second order are in fact considerably diminished, yet that the rotary force vector produced by the horizontal force component does not become too large. In this way, at low costs and while saving considerable space, an inertia force is obtained providing an equilibrium such that even at high speeds of the sewing machine, only small vibrations are produced.

If the machine is a lockstitch sewing machine where a take-up lever secured to the needle bar is provided which, therefore, moves in synchronism therewith, the inertia forces produced by the lever can also be compensated for namely the inertia forces of first order completely and those of second order substantially, by correspondingly dimensioning the counterbalance weights so that a minimum vibration run at high speeds can be obtained particularly in lockstitch sewing machines too.

In accordance with the invention there is provided a sewing machine which includes an armshaft arranged to drive a counterbalancing shaft which carries a third counterbalancing weight and a sleeve which is rotatably supported on the counterbalancing shaft which carries a second counterbalancing weight so that the counterbalancing shaft is driven at twice the speed of the armshaft by gearing connected therebetween and the sleeve in turn is driven by the counterbalancing shaft at one half the speed and in the opposite direction of the counterbalancing shaft and carries the second counterbalancing weight in an arrangement wherein the first counterbalancing weight which counterbalances the drive of the needle rotates oppositely to the second counterbalancing weight which entirely compensates for the inertia forces of the first order produced by the needle bar and a take-up lever and a portion of the driving link and with the horizontal force components produced by first and second counterbalancing weight being neutralized so that they do not exert any influence on the housing of the machine and the third counterbalancing weight which rotates at double the speed of the armshaft compensates for most of the inertial forces of the second order produced by the needle bar take-up lever and the link.

A further object of the invention is to provide a sewing machine that has a counterbalancing system which is effective and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 1 is a partial sectional view of a sewing machine housing accommodating the needle bar drive and the mechanism for driving the counterbalance weights;

FIG. 2 is a sectional view taken along the line II—II of FIG. 1; and

FIG. 3 is a sectional view taken along the line III—III of FIG. 1.

DESCRIPTION OF THE PREFERRED EMBODIMENTS

Referring to the drawings in particular the invention embodied therein comprises a sewing machine which includes a needle bar 10 which is driven from an armshaft 3 in a manner such that the forces of operation of the device are counterbalanced effectively.

FIG. 1 shows a part of the arm 1, and the head 2 of a sewing machine. An armshaft 3 mounted in arm 1 carries a crank 4 to which a crank pin 5 is secured and which is designed with an oppositely extending counterbalance weight 6. Crank pin 5 is connected through a link 7 to a needle bar 10 which is movable up and down in guides 8, 9. Needle bar 10 carries on its lower end a needle holder 11 with a thread guiding needle 12, and on its upper end a take-up lever 13 (shown only partly), such as needed for lockstitching.

In the wall 14 provided between arm 1 and head 2, a cylindrical insert 15 is secured. Mounted for rotation in insert 15 is a sleeve 16 forming along with a concentric bearing sleeve 17 a bearing for armshaft 3. Sleeve 16 carries a gear 18 rotating in a bore 19 of larger diameter provided in insert 15. A slotted counterbalance weight 21 is clamped by a screw 20 to the end of sleeve 16 projecting from an insert 15.

At either side of a recess 22 of insert 15, a sleeve bearing 23, 24 is provided, in which a shaft 25 is received. Secured to shaft 25 with recess 22 is a gear 26 meshing with gear 18.

Shaft 25 carries a cogged wheel 27, and another cogged wheel 28 is secured to armshaft 3. The two cogged wheels 27, 28 are connected to each other by a cog belt 29. A counterbalance weight 30 is secured to the end of shaft 25.

The number of teeth or cogs of driving wheel 28 is twice the number of cogs of driven wheel 27, so that the two wheels 27, 28 and belt 29 form a transmission gearing 31 having a speed ratio of 1:2. Conversely, the number of teeth of drive gear 26 to that of driven gear 18 is 1:2, so that gears 18, 26 form a reduction gearing having a speed ratio of 2:1. The two gearings 31, 32 form along with intermediate shaft 25 a drive mechanism 33 for the two counterbalance weights 21 and 30.

With the sewing machine in operation, armshaft 3 drives through crank 4 and link 7, needle bar 10 and take-up lever 13, with counterbalance weight 6 rotating in synchronism with armshaft 3. The rotation of armshaft 3 is transmitted through cog belt 29, in the same direction, to shaft 25, and shaft 25 along with counterbalance weight 30 rotate at a double speed relative to the armshaft, since the transmission ratio is 1:2. Shaft 25 drives through gears 26 and 18, sleeve 16 which, along with counterbalance weight 21, rotates at the same speed as armshaft 3 and counterbalance weight 6, only in the opposite direction, since the transmission ratio is 2:1.

The two oppositely rotating counterbalance weights 6 and 21 entirely compensate for the inertia forces of first order produced by needle bar 10, take-up lever 13, and a portion of link 7, with the horizontal force components produced by counterbalance weights 6 and 21 neutralizing each other and exerting no influence on the housing of the machine. Counterbalance weight 30 rotating at a double speed is dimensioned to compensate for most of the inertia forces of second order produced by needle bar 10, take-up lever 13 and a portion of link 7, but to prevent the horizontal force component from becoming excessive.

While specific embodiments of the invention have been shown and described in detail to illustrate the application of the principles of the invention, it will be understood that the invention may be embodied otherwise without departing from such principles.

What is claimed is:

1. In a sewing machine including an armshaft, a reciprocating needle driven by the armshaft and a first counterbalancing weight rotatably driven by the armshaft, the improvement comprising, a sleeve rotatably mounted on the armshaft, a gear affixed to said sleeve for rotation therewith, a second counterbalance carried by said sleeve and rotatable therewith, a cylindrical insert mounted in a sewing machine and rotatably supporting said sleeve, a counterbalanced shaft rotatably supported in said sleeve, a third counterbalance carried by said counterbalance shaft and rotatable therewith, first transmission gearing between said counterbalance shaft and said armshaft driving said counterbalance shaft from said armshaft and twice the speed of said armshaft for a ratio of 1:2 and in the same direction and second transmission gearing between said counterbalance shaft and said sleeve and driving said sleeve from said counterbalance shaft at half the rotational speed of the counterbalancing shaft for a ratio of 2:1 and in an opposite direction.

2. In a sewing machine according to claim 1, wherein said first transmission gearing comprises a cog belt drive and said second transmission gearing comprises a toothed gear drive.

3. In a sewing machine comprising a needle bar which is movable up and down and drivable through a crank secured to an armshaft and a link and with a first counterbalancing weight connected to the crank, and a second counterbalance weight which is driven through an armshaft connected drive mechanism in an opposite direction, the improvement wherein the drive mechanism comprises an intermediate, and a third counterbalanced weight carrying shaft which is driven through a transmission gearing connected between the armshaft and the intermediate shaft at a speed ratio of 1:2 and which in turn drives the second counterbalancing weight through a reduction gearing and an intermediate shaft to counterbalancing weight speed of 2:1.

* * * * *